United States Patent [19]

Penird et al.

[11] 4,310,779

[45] Jan. 12, 1982

[54] CATHODE RAY TUBE SHIELD-FUNNEL CONNECTIVE MEANS

[75] Inventors: Carl W. Penird, Waterloo; Peter G. Puhak, Seneca Falls, both of N.Y.

[73] Assignee: North American Philips Consumer Electronics Corporation, New York, N.Y.

[21] Appl. No.: 116,367

[22] Filed: Jan. 28, 1980

[51] Int. Cl.[3] ..... H01J 29/06; H01J 29/02

[52] U.S. Cl. ..... 313/407; 313/451

[58] Field of Search ..... 313/402–408, 313/451

[56] References Cited

U.S. PATENT DOCUMENTS 3,541,373 11/1970 Barr ..... 313/407

3,931,541 1/1976 Brenner ..... 313/407

*Primary Examiner*—Eli Lieberman

*Attorney, Agent, or Firm*—John C. Fox

[57] ABSTRACT

The invention relates to improved combination means for effecting an electrical connection in a cathode ray tube between an internal magnetic shield and a conductive coating disposed on the interior surface of the funnel portion of the tube envelope. The longitudinal connector employs a configurated clip-type attachment element which securely mates with a fluting formed on the shield to provide a rapidly achieved secure attachment.

5 Claims, 5 Drawing Figures

CATHODE RAY TUBE SHIELD-FUNNEL CONNECTIVE MEANS

TECHNICAL FIELD

This invention relates to combination means for expeditiously effecting an electrical connection in a cathode ray tube between an internal magnetic shielding member and the funnel portion of the envelope and more particularly to the combination of a clip-on contactor mated to a discretely formed open-channel fluting on the shielding member.

BACKGROUND ART

Cathode ray tubes, such as those employed in color television and allied display applications, are often provided with a magnetic shielding arrangement to protect the tube from numerous stray voltages, currents and magnetic fields, including the earth's magnetic field, which tend to adversely affect the desired performance of the tube. While shielding means externally surrounding the tube have been extensively utilized, it has been found that magnetic shields internally disposed within the tube envelope have resulted in better shielding effects and marked improvement in tube performance.

It has been conventional practice to weld a flexible electrical contactor to the rear portion of the shielding member to bridge across and make electrical connection with the conductive coating on the interior surface of the funnel portion of the tube. Welding tends to erratically produce splatter or loose particles which may result in impairment of the shadow mask by deleteriously blocking apertures therein. The resultant diminution of tube operational efficiency increases manufacturing loss and associated costs.

DISCLOSURE OF INVENTION

The present invention is addressed to combination means employed in a cathode ray tube to expeditiously effect an electrical connection between the internally disposed magnetic shield and the conductive coating on the interior surface of the funnel. The shielding member has a narrow open-channel fluting formed on the border portion of the rear opening. This fluting is shaped as a rib-like construction having a forwardly effected protrusion with an opposed rearward facing open-channel formation. A longitudinal metallic contactor, oriented to make contact with the funnel disposed coating, has a resilient clip-type terminal attachment element configurated to substantially mate with the open-channel fluting. A protuberance in the attachment element is formed to substantially seat in the open-channel side of the fluting, while an integral and substantially opposed hook-like portion clasps the counter rib-like protrusion of the fluting in a manner to lock the protuberance in seated placement in the channel. Thus, by the discrete interaction of the fluting and the configurated attachment, the contactor is securely affixed to the shielding member to accomplish electrical contact with the funnel.

BEST MODE FOR CARRYING OUT THE INVENTION

For a better understanding of the present invention together with the advantages and capabilities thereof, reference is made to the following specification and appended claims in connection with the aforedescribed drawings.

With reference to the drawings, there is shown a combination connective means for conveniently effecting an internal electrical connection, within a cathode ray tube, between an internal magnetic shielding member and the conductive coating disposed on the adjacent sidewall of the encompassing funnel portion of the tube envelope.

Figure 1:
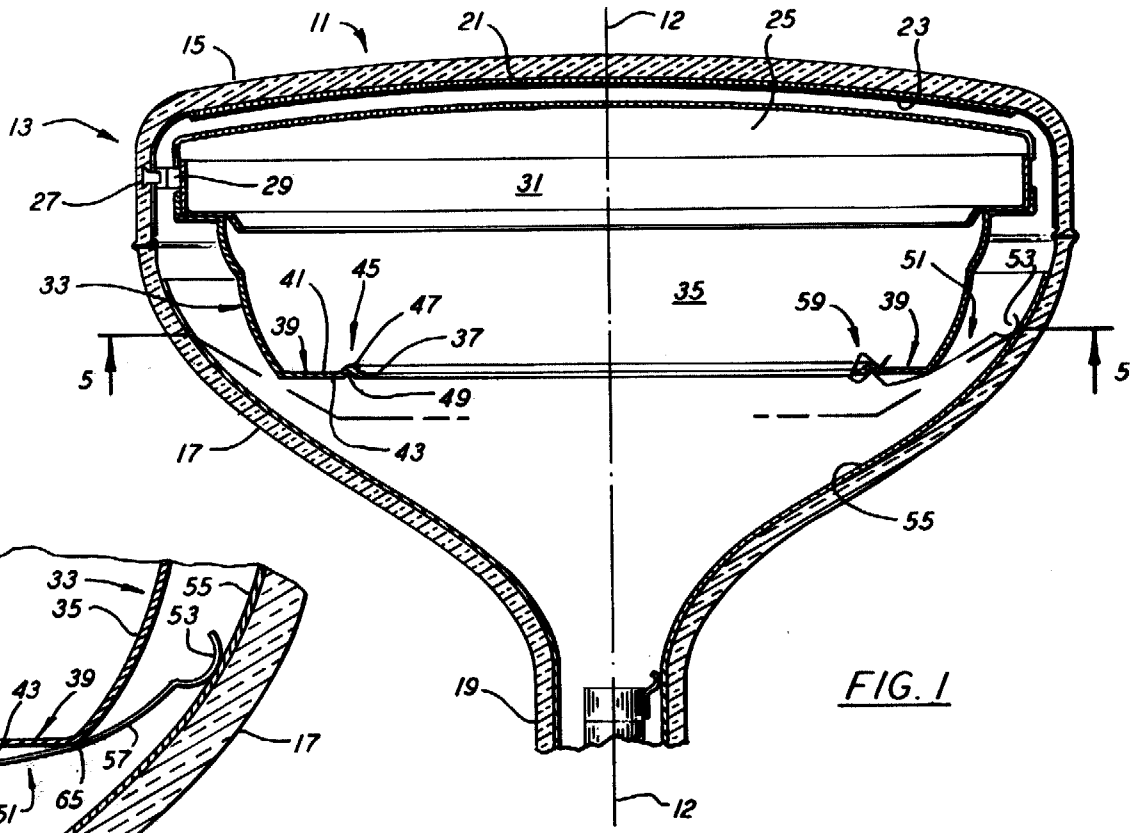
FIG. 1 is a cross-section of a color cathode ray tube wherein the inventive combination is employed.

The cathode ray tube 11, shown in FIG. 1, is an exemplary color tube having a longitudinal axis 12 therethrough, and embodying an envelope 13 comprised of an integration of viewing panel 15, funnel 17 and neck 19 portions. Adhered to the inner surface of the viewing panel 15 is a patterned cathodoluminescent screen 21 formed of a multitude of discrete areas of color-emitting phosphor materials. A thin metallized film 23, such as aluminum, is usually applied over the interior surface of the screen and a portion of the sidewall area of the panel. A multi-apertured structure or shadow mask member 25 is spatially related to the patterned screen 21; such being predeterminately positioned within the viewing panel 15 by a plurality of stud-like mask supporting members 27 partially embedded in the panel sidewall in spaced-apart orientation. Mating with these supporting studs are a like member of mask locator means 29 which are suitably affixed to the frame portion 31 of the mask member 25.

Securely attached to the rear portion of the mask frame, as by a plurality of clips or welding, is an inner-shield or internal magnetic shielding member 33. This structure, formed of thin metal, such as cold rolled steel, is shaped to evidence a continuous contoured bowl-like sidewall enclosure 35 having front and rear openings discretely formed therein. The rear opening in the shielding member 33 is defined by the terminal periphery 37 of a continuous instanding ledge element 39 extending inward from the sidewall enclosure 35 toward the axis 12, and as such constitutes the rear surrounding border portion of the shield. To aid in subsequent description of the invention, this bordering ledge 39 is further defined as having a forwardly oriented alpha surface 41 and a rearwardly oriented beta surface 43.

Figure 2:
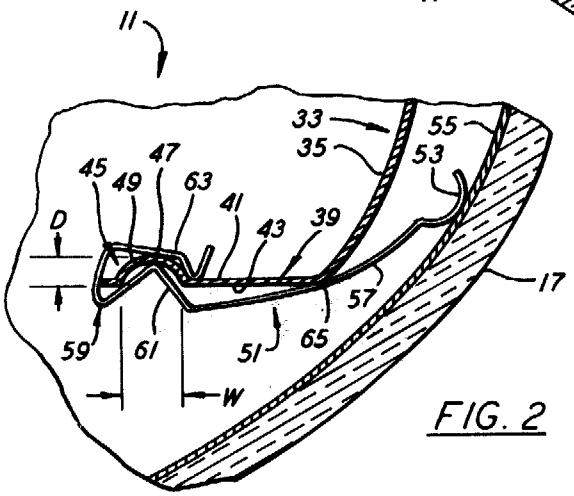
FIG. 2 is an enlarged portion of FIG. 1 detailing the elements of the invention.
Figure 3:
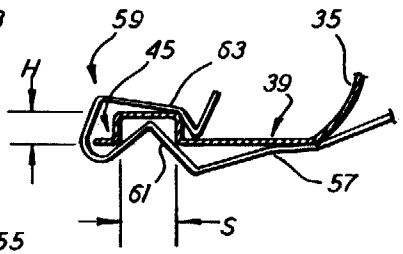
FIG. 3 is an enlarged portion of FIG. 1 illustrating another sectional shaping of the fluting portion of the combination.
Figure 4:
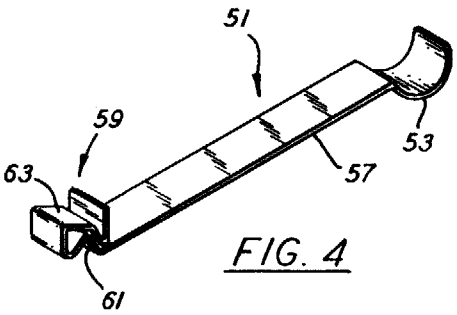
FIG. 4 is an illustration of one embodiment of the contactor portion of the combination.
Figure 5:
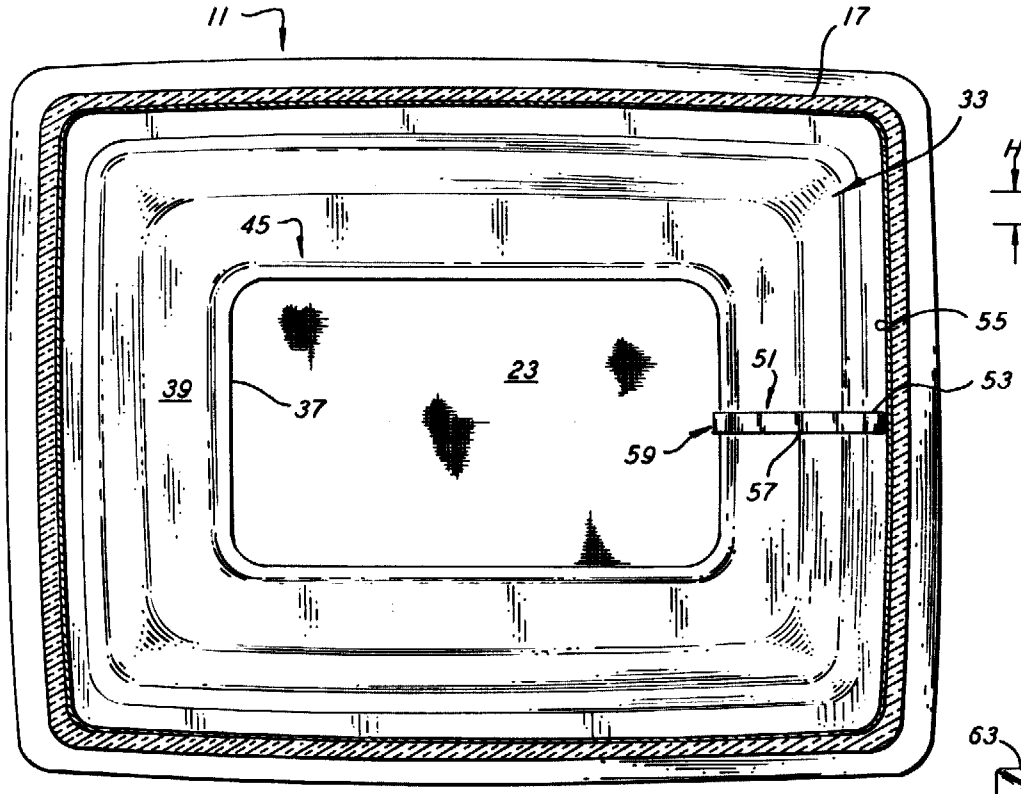
FIG. 5 is a cross section of the tube shown in FIG. 1, taken along the line 5—5 thereof, illustrating orientation of the combination connective means.

One of the components of the combination connective means of the invention is a narrow open-channel fluting 45 formed in the rear bordering ledge element 39 of the shielding member 33 adjacent the terminal periphery 37 thereof. As shown in FIGS. 1, 2 and 3, the cross sectional configuration of this fluting evidences a defined width "W" and a defined depth "D". Such shaping produces a forward-effected rib-like protrusion 47 extending from the alpha surface 41 of the ledge 39, and an opposed open-channel counter formation 49 facing rearward from the beta surface 43 of the ledge.

The other component of the combination connective means of the invention cooperates with the aforedescribed fluting formation in the shielding member. This second component is a substantially longitudinal contactor member 51 fabricated of a resilient metallic material, as for example, stainless steel. The structure of this member is an integration of a terminal contact element 53 fashioned to effect contact with the conductive coating 55 disposed on the interior surface of the funnel 17, an intermediate flexural element 57, and a clip-action attachment element 59 discretely configurated to mate with the fluting 45 formed in the bordering ledge 39 of the magnetic shielding member. The configurative bending or shaping of the contactor material in fabricating the attachment element 59 produces a protuberance portion 61 which evidences a defined slope "S" and higher "H" that substantially mates with the defined width "W" and depth "D" of the open-channel formation 49 of the fluting, thereby effecting seating cooperation. An additional and related configurative bending of the contactor material is a fold-back formation providing a substantially opposed hook-like portion 63 which is positioned to concomitantly clasp the rib-like protrusion 47 of the fluting, and thereby lock the protuberance portion 61 in positive seated placement in the opposed channel 49.

The final orientation of the contactor member 51, as shown in FIGS. 1 and 2, bends the intermediate element 57 of the contactor against the edge 65 of the shielding member 33 to form an advantageous leverfulcrum relationship. This further effects a cooperative locking force on the configurated attachment combination, by inducing additional seating pressure of protuberance 61 in channel 49; such is clearly evidenced in FIG. 2. Thus, the clip attachment 59 of the contactor in cooperation with the fluting 45 on the shielding member 33 provides an expeditious combination connective means to effect affixture of the contactor member 51 to the magnetic shielding member 33 in a manner to orient the integral flexural and contact elements, 57 and 53, positionally to consummate electrical connection with the flannel-disposed coating 55.

The fluting component 45 formed in the ledge 39 of the shielding member 33 is shown in FIG. 2 as being of substantially arcuate cross-section. Another embodiment, illustrated in FIG. 3, shows the fluting 45 to be of substantially semi-rectangular cross section. In each instance the width "W" and depth "D" relationship of the channel are in keeping with the slope "S" and height "H" relationship of the attachment protuberance portion 61 to insure a positive seating arrangement. While only a limited area of fluting is utilized for contactor affixment, it has been found beneficial to extend the fluting as a continuous formation extending substantially completely around the bordering ledge 39 thereby providing additional strengthening thereto.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The combination connective means of the invention, which has expeditious utilization in the manufacture of cathode ray tubes employing internal magnetic shields, represents improved means for easily and positively affixing an electrical contactor to the shielding member. The described clip-on securement combination forgoes weld means for attaching the connector to the shield, and thereby eliminates the possible presence of deleterious particles resultant from weld splatter. In addition, this connective means eliminates the need for welding equipment and an operator for the same. The combination connective means is quickly assembled and effects secure attachment. Thus, the means is markedly beneficial to both tube manufacturing and resultant tube quality.

We claim:

1. An improvement in a cathode ray tube having a longitudinal axis therethrough and an internal magnetic shielding member spatially disposed substantially within the envelope funnel portion thereof, said shielding member evidencing a continuous contoured bowl-like sidewall enclosure with front and rear openings discretely formed therein, said rear shield opening being defined by the terminal periphery of a continuous instanding ledge element extending inward from said sidewall toward said axis, said ledge constituting the rearward surrounding border portion of said shield, having a forwardly oriented alpha surface and a rearwardly oriented beta surface said improvement being combination connective means for effecting electrical connection between said shielding member and the adjacent conductive coating disposed on the interior surface of said encompassing funnel portion, said combination means comprising:

a narrow open-channel fluting formed in the bordering ledge element of said shield adjacent the terminal periphery thereof, the sectional configuration of said fluting evidencing defined width and depth thereby producing a forward-effected rib-like protrusion from the alpha surface of said ledge and an opposed open-channel counter formation facing rearward from the beta surface of said ledge; and a substantially longitudinal metallic contactor member formed of an integration of a discretely configurated resilient attachment element, an opposed contact element and an intermediate flexural element; said attachment element incorporating a protuberance portion having a defined slope and height formed to substantially seat in the open-channel formation of said fluting and an intergral and substantially opposed hook-like portion shaped as a fold-back formation positioned to concomitantly clasp the rib-like protrusion of said fluting thereby effecting locking of said protuberance portion in positive seated placement in said channel, thusly affixing said contactor member to said shielding member in a manner to orient said integral flexural and contact elements in a position to consummate electrical connection with said funnel-disposed coating.

2. The improved cathode ray tube internal shielding member combination connective means according to claim 1 wherein the slope and height relationship of said protuberance substantially effects seating thereof within the width and depth relationship fo said open-channel fluting.

3. The improved cathode ray tube internal shielding member combination connective means according to claim 1 wherein said open-channel fluting of said shielding member is of substantially arcuate cross section.

4. The improved cathode ray tube internal shielding member combination connective means according to claim 1 wherein said open-channel fluting of said shielding member is of substantially semi-rectangular cross section.

5. The improved cathode ray tube internal shielding member combination connective means according to claim 1 wherein said open-channel fluting of said shielding member is a continuous formation extending substantially completely around said bordering ledge element.

* * * * *